US008006764B2

(12) United States Patent
Adamek et al.

(10) Patent No.: US 8,006,764 B2
(45) Date of Patent: Aug. 30, 2011

(54) ADJUSTABLE THREADED HANGER

(75) Inventors: Frank C. Adamek, Pasadena, TX (US); David McGuckien, Aberdeen (GB); Jim Sinnott, Paisley (GB)

(73) Assignee: Vetco Gray Inc., Houston, TX (US)

( * ) Notice: Subject to any disclaimer, the term of this patent is extended or adjusted under 35 U.S.C. 154(b) by 723 days.

(21) Appl. No.: 12/137,294

(22) Filed: Jun. 11, 2008

(65) Prior Publication Data

US 2008/0308278 A1 Dec. 18, 2008

Related U.S. Application Data

(60) Provisional application No. 60/944,614, filed on Jun. 18, 2007.

(51) Int. Cl.
*E21B 7/12* (2006.01)

(52) U.S. Cl. ..... 166/348; 166/345; 166/338

(58) Field of Classification Search ..... 166/338, 166/343, 345, 348, 382, 383
See application file for complete search history.

(56) References Cited

U.S. PATENT DOCUMENTS

| | | | | |
|---|---|---|---|---|
| 4,585,369 | A * | 4/1986 | Manesse et al. | 403/322.3 |
| 4,794,988 | A | 1/1989 | van Bilderbeek | |
| 4,938,289 | A | 7/1990 | Van Bilderbeek | |
| 5,060,724 | A | 10/1991 | Brammer et al. | |
| RE34,071 | E | 9/1992 | Van Bilderbeek | |
| 5,255,746 | A | 10/1993 | Bridges | |
| 5,259,459 | A * | 11/1993 | Valka | 166/345 |
| 6,234,252 | B1 * | 5/2001 | Pallini et al. | 166/345 |
| 6,666,272 | B2 * | 12/2003 | Singeetham et al. | 166/345 |
| 2004/0168810 | A1 | 9/2004 | Emmerson | |
| 2006/0016604 | A1 | 1/2006 | Ford | |

* cited by examiner

*Primary Examiner* — Thomas A Beach
*Assistant Examiner* — James G. Sayre
(74) *Attorney, Agent, or Firm* — Bracewell & Giuliani LLP

(57) ABSTRACT

An adjustable hanger for retaining in tension casing and tubing extending between a subsea wellhead and a surface wellhead on a platform.

9 Claims, 5 Drawing Sheets

ADJUSTABLE THREADED HANGER

CROSS REFERENCE TO RELATED APPLICATIONS

This application claims the benefit of the filing date of U.S. provisional patent application Ser. No. 60/944,614, filed on Jun. 18, 2007, the disclosure of which is incorporated herein by reference.

FIELD OF THE INVENTION

This invention relates in general to offshore well production equipment, and in particular to an adjustable hanger for retaining in tension casing and tubing extending between a subsea wellhead and a surface wellhead on a platform.

BACKGROUND

The ability to tension casing or tubing following a tieback of the casing or tubing to a subsea wellhead or a mudline hanger is difficult to perform when such tensioning must be provided under BOP control. As a result, adjustable casing or tubing hanger systems can be prohibitively expensive and unduly complex. The present exemplary embodiments of the invention are directed to at least minimizing some of the limitations and drawbacks to conventional systems for hanging casing or tubing.

DETAILED DESCRIPTION OF THE INVENTION

Figure 1:
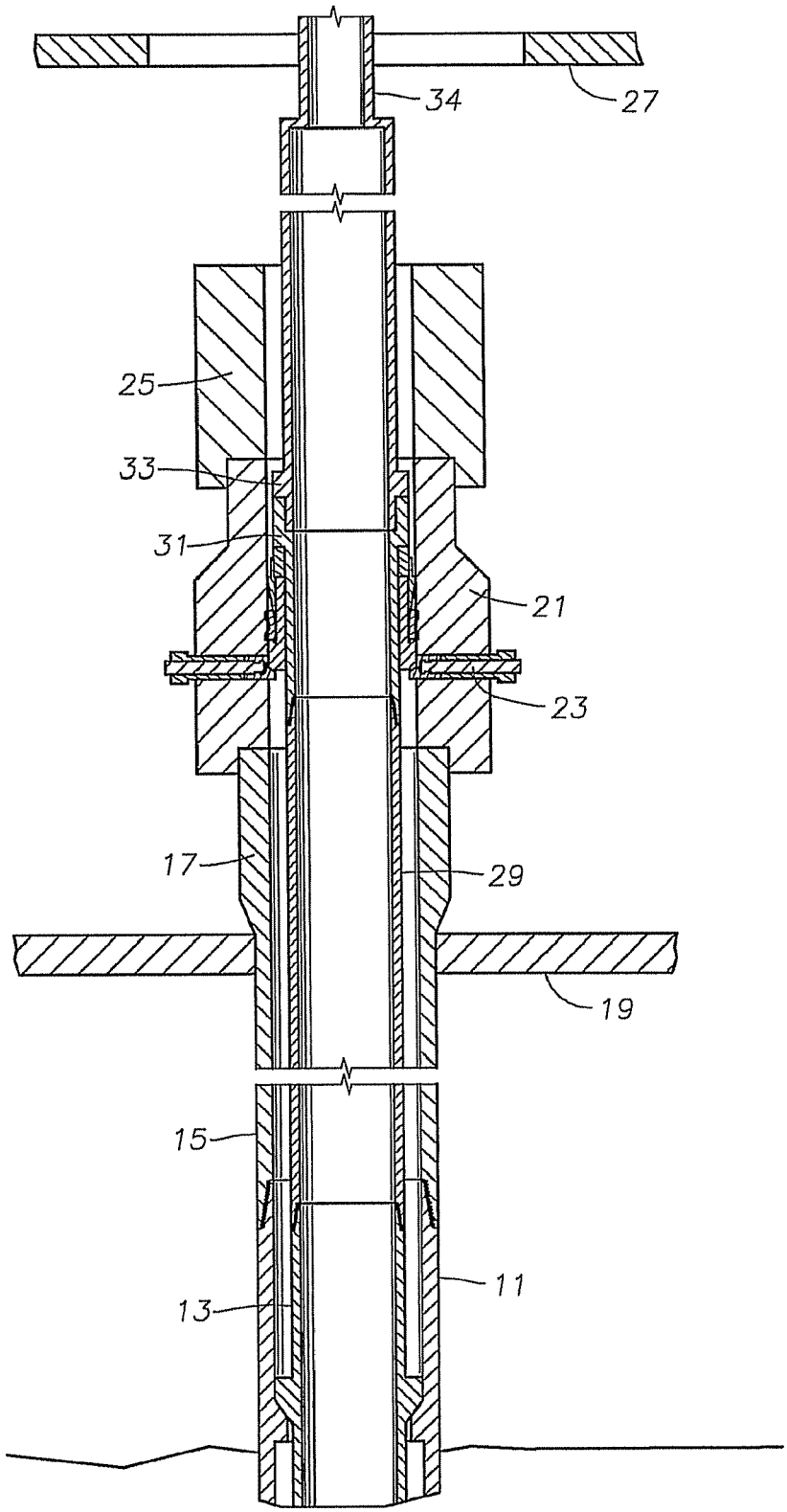
FIG. 1 is a schematic view illustrating casing being tensioned between a subsea wellhead and a surface wellhead in accordance with this invention.

Referring to FIG. 1, a well has a subsea wellhead assembly that in this example includes a mudline housing 11 located at the upper end of large diameter conductor pipe extending into the well. A subsea casing hanger 13 is landed in housing 11 for supporting a first string of casing extending into the well. Another casing hanger (not shown) could subsequently land in casing hanger 13 for supporting a second string of casing. Additional strings of casing could be similarly supported. With a mudline subsea completion as illustrated, casing hanger 13 does not seal to mudline housing 11, and the additional casing hanger would not seal to subsea casing hanger 13. Alternatively, housing 11 could comprise a subsea wellhead housing wherein the casing hangers land and seal to the housing.

A platform 19 is connected to the subsea wellhead assembly by a conductor pipe 15, which ties back to subsea housing 11 and extends upward to a surface wellhead assembly on well deck 19 of the platform. In this example, the platform is supported on legs that extend to the seafloor, thus well deck 19 is fixed and not subject to wave movement. The surface wellhead assembly includes a housing 17 located at the upper end of conductor pipe 15 and supported by well deck 19. A casing head or housing 21 is mounted on surface housing 17. Casing head 21 has a plurality of retractable load shoulders 23 in this embodiment; however fixed load shoulders can also be utilized. A blowout preventer 25 (BOP) is shown connected to the upper end of casing head 21. Additional casing heads and a tubing head may be located between casing head 29 and BOP 25. BOP 25 is located below a drill floor 27 of the platform 19. After the well is completed, BOP 25 is removed and a production tree is installed.

FIG. 1 also shows a string of casing 29 being tied back ftom subsea casing hanger 13 to surface casing head 21. A casing hanger 31 is located at the upper end of casing 29 for supporting casing 29 on load shoulders 23 of casing head 21. A running tool 33 secured to a running string 34 runs casing 29. With running string 34, the operator rotates the assembly to cause casing 29 to tie into engagement with subsea casing hanger 13, then pulls upward to place a desired amount of tension on casing 29. The operator then causes running tool 33 to rotate hanger 31 downward onto load shoulders 23 while simultaneously holding casing 29 in tension. After casing hanger 31 is in contact with load shoulders 23, the operator can remove running tool 33, and casing hanger 31 will support casing 29 with the desired amount of tension. The task of setting surface casing hanger 31 onto load shoulders 23 with the desired amount of tension in casing 29 is handled remotely from rig floor 27 through blowout preventer 25 as will be explained subsequently.

Figure 2:
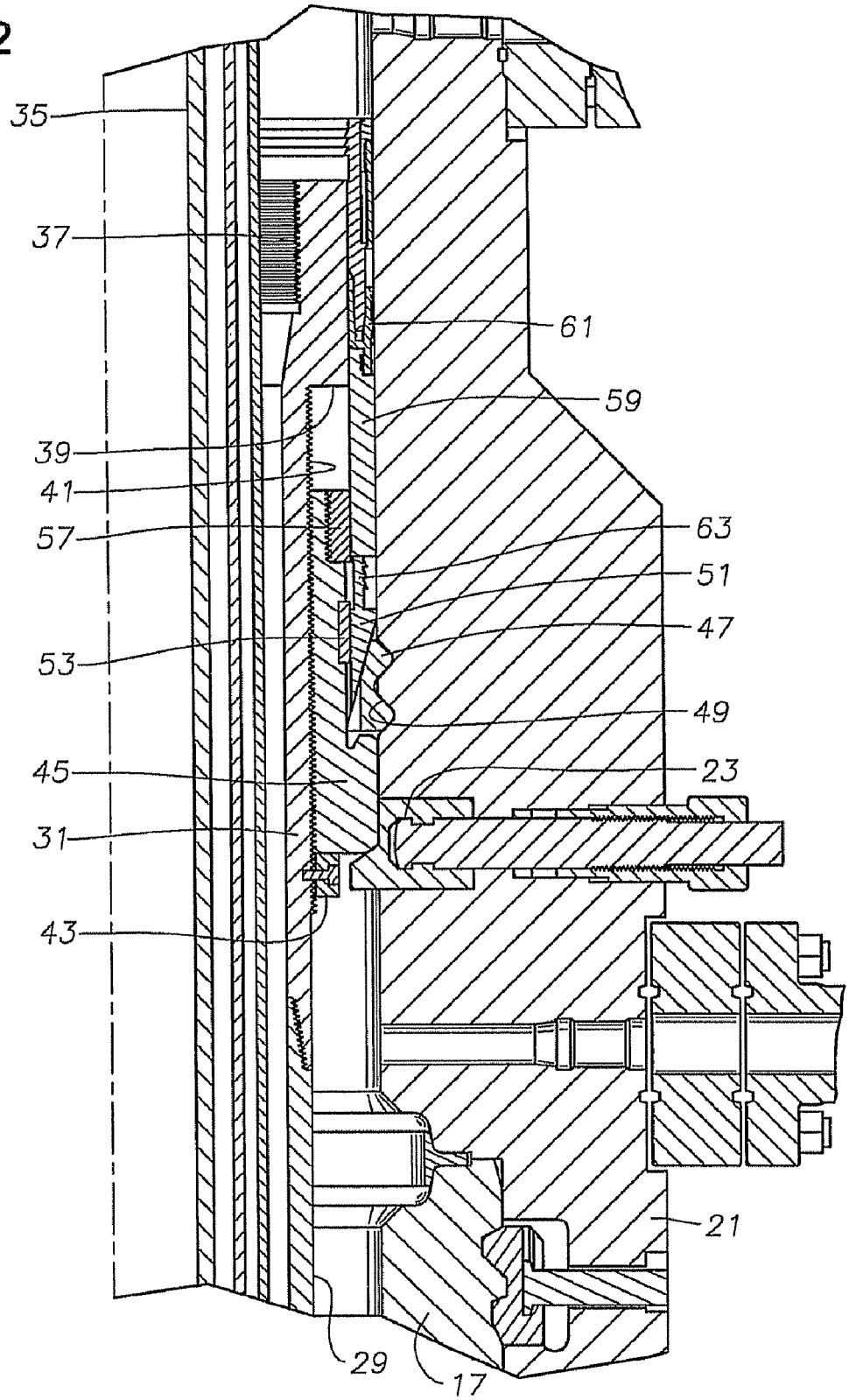
FIG. 2 is a quarter-sectional view illustrating the surface wellhead and casing hanger of the system shown in FIG. 1, and shown in a position supporting the casing in tension.

Referring to FIG. 2, more details of the assembly of casing hanger 31 are shown with casing hanger 31 in a set position with tension applied. FIG. 2 also illustrates three inner strings 35, two of casing and one of tubing, that are also supported and tensioned by similar mechanisms that are not shown and are located above casing head 21. Casing hanger 31 has threads on its lower end that are secured to casing 29. Casing hanger 31 has internal threads 37 on its upper end that are engaged by running tool 33 (FIG. 1) to support casing hanger 31. The upper end of casing hanger 31 is thicker than its lower portion and has a downward facing shoulder 39 on its exterior. A set of exterior threads 41 begin just below shoulder 39 and extend downward to near the lower end of casing hanger 31. A stop ring 43 may be secured to external threads 41 at the lower end. Stop ring 43 has a shear screw to maintain stop ring 43 at a desired non-rotating position on threads 41.

Figure 4:
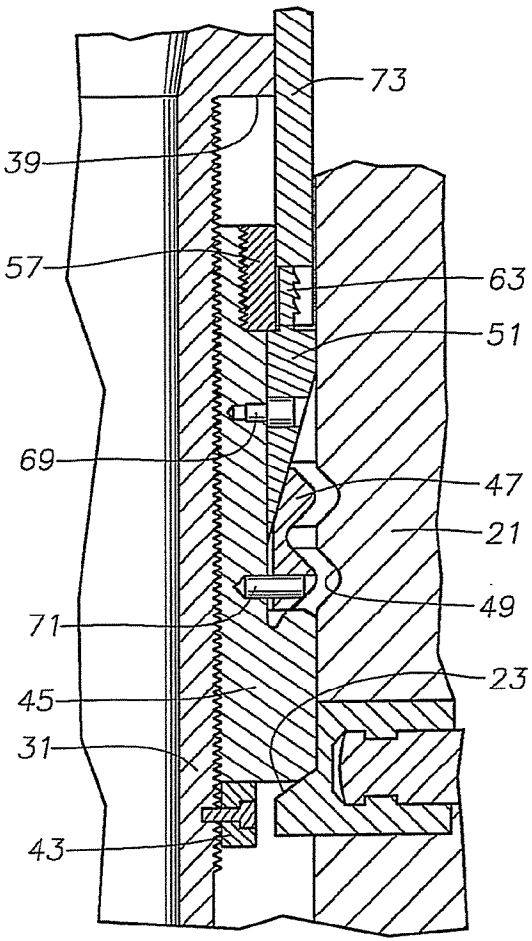
FIG. 4 is a sectional view of the casing hanger assembly of FIG. 2, with the outer body of the casing hanger assembly rotated down to support tension in the casing.

The assembly of casing hanger 31 includes a tubular outer body 45 that has internal threads that secure to external threads 41. Outer body 45 can be rotated between a lower position shown in FIG. 2, with its lower end contacting stop ring 43, and an upper position with its upper end contacting shoulder 39, shown in FIG. 3. Outer body 45 has a lower conical portion that rests on retractable load shoulders 23 when they are advanced inward as shown in FIG. 4. Outer body 45 thus transmits the weight and tension in casing 29 to load shoulders 23.

In this embodiment, means are also provided to prevent any upward movement of casing hanger 31 due to thermal growth or unexpected well pressure. In this example, the means includes a split ring 47 that is carried on the exterior of outer body 45. Initially, split ring 47 is retracted to the position shown in FIG. 3. In the expanded position shown in FIG. 5, split ring 47 engages a mating grooved profile 49 formed in the bore of casing head 21.

The casing hanger assembly includes an energizing ring 51 that has two functions; the functions being transmit rotation to outer body 45 and also to wedge split ring 47 into engagement with profile 49. Energizing ring 51 has a tapered exterior that mates with a tapered surface on the inner diameter of split ring 47 to cause it to move outward when energizing ring 51 is pushed downward. A plurality of torque keys 53 (only one shown) are located in mating grooves in the inner diameter of energizer ring 51 and on the outer diameter of outer body 55. Torque keys 53 transmit rotational movement of energizing ring 51 to outer body 45. A retainer ring 57 secures to an upper portion of outer body 45 to hold torque keys 53 and energizing ring 51 on outer body 45.

FIG. 2 also illustrates a spacer ring 59 that extends between the upper end of energizer ring 51 and a conventional seal assembly 61. Seal assembly 61, for example, may be a metal-to-metal seal that seals between the outer diameter of the upper portion of casing hanger 31 and the bore of casing head 21. Seal assembly 61 is installed conventionally after outer body 45 is in the set position of FIG. 5.

Figure 6:
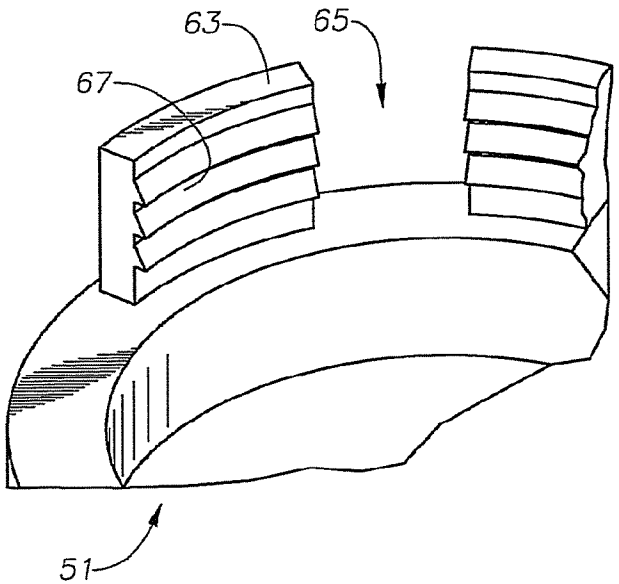
FIG. 6 is a perspective view of a portion of an energizing ring of the casing hanger assembly shown in FIGS. 2-5.

Referring to FIG. 6, energizing ring 51 has means for receiving torque transmitted from running tool 33 (FIG. 1). This means includes a series of lugs 63 arranged in the form of a castellation on the upper end. Each lug 63 is a partially-cylindrical segment separated by slots 65 from the adjacent lugs 63. Also, preferably, energizing ring 51 has a plurality of grooves 67 formed on the inner diameter side of each lug 63. Grooves 67 enable an operator to insert a retrieval tool to pull energizing ring 51 upward from the position shown in FIG. 2 to enable split ring 47 to retract for retrieving hanger 31, if desired.

Figure 3:
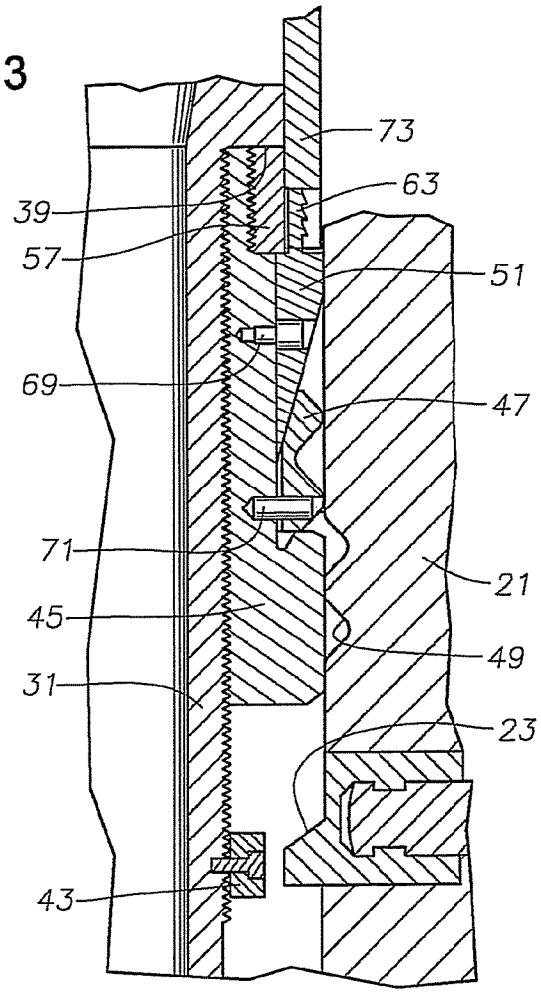
FIG. 3 is a sectional view of the casing hanger assembly of FIG. 2, shown in a preliminary position.

Referring to FIG. 3, which is a view of outer body 45 in a running-in position, preferably one or more shear pins 69 releasably hold energizing ring 51 in the upper position. Shear pins 69 extend through energizing ring 51 into outer body 45. Split ring 47 is inwardly biased and may be restrained against rotation by means of anti-rotation pins 71, shown in FIG. 3. A torque sleeve 73 of running tool 31 (FIG. 1) slides between the outer diameter of the upper portion of casing hanger 31 and the bore of casing head 21 and also between retainer ring 57 and the bore of casing head 21. Torque sleeve 73 extends into engagement with lugs 63 (FIG. 3) to rotate energizing ring 51 and outer body 45.

Figure 7:
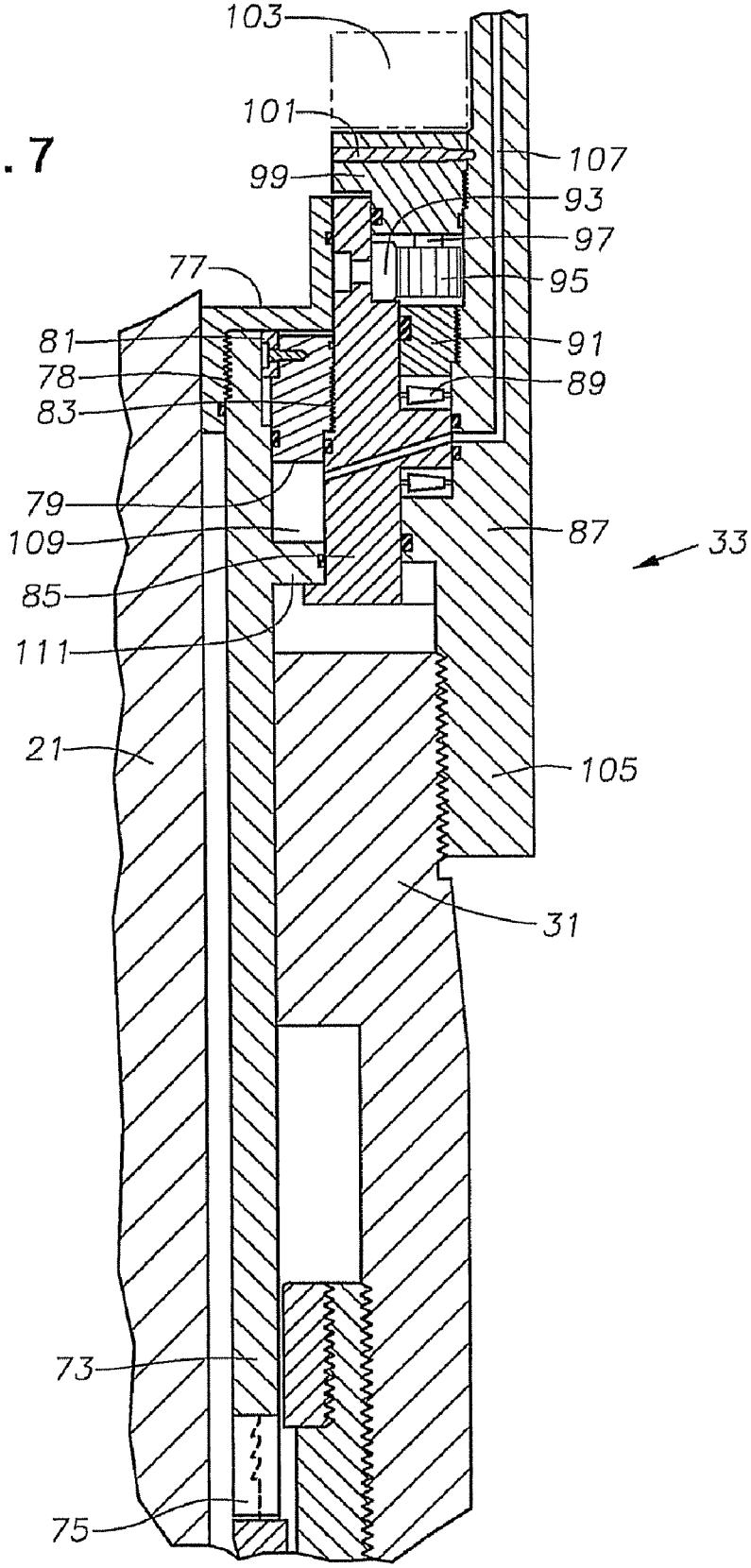
FIG. 7 is a quarter-sectional view illustrating portions of a running tool for the casing hanger assembly shown in FIGS. 2-5.

FIG. 7 illustrates one example of a running tool 33, showing torque sleeve 73 has lugs 75 on its lower end that engage lugs 63 (FIG. 6) of energizing ring 51. Torque sleeve 73 is secured to a protective cap member 77 by threads 78. An end cap 79 is located within the inner diameter of torque sleeve 73 just below cap member 77. End cap 79 and torque sleeve 73 have mating torque keys 81 for transmitting rotational movement of end cap 79 to torque sleeve 73. Torque keys 81 allow torque sleeve 73 to move vertically relative to end cap 79. End cap 79 is secured by threads 83 to an inner support body 85. Inner support body 85 is carried by a mandrel or hub 87. Upper and lower bearings 89 facilitate rotational movement of inner support body 85 relative to hub 87. A retainer ring 91 is secured by threads to hub 87 over the upper set of the bearings 89 to retain inner support body 85 with hub 87.

A driven gear 93 is mounted near the upper end and on the inner diameter of inner support body 85. Driven gear 93 is in engagement with a drive gear 95. Drive gear 95 is mounted on a shaft 97 of a torque unit 99. Torque unit 99 may comprise a gear box and is stationarily mounted to hub 87 by means of threads and also an anti-rotation pin 101. Torque unit 99 is driven by a motor 103. Motor 103 may be electrical or hydraulic and causes rotation of drive gear 95, which in turn results in rotation of torque sleeve 73 relative to hub 87. Power is supplied to motor 103 from the surface.

Hub 87 is a tubular member with a lower portion having external threads 105. Threads 105 engage internal threads 37 (FIG. 2) of casing hanger 31 to support casing hanger 31 and casing 29. The upper end of hub 105 is threaded for securing to running string 34 (FIG. 1). Torque sleeve 73 locates between the outer diameter of casing hanger 31 and inner diameter of casing head 21. Lugs 75 engage lugs 63 (FIG. 6) on energizing ring 51.

Figure 5:
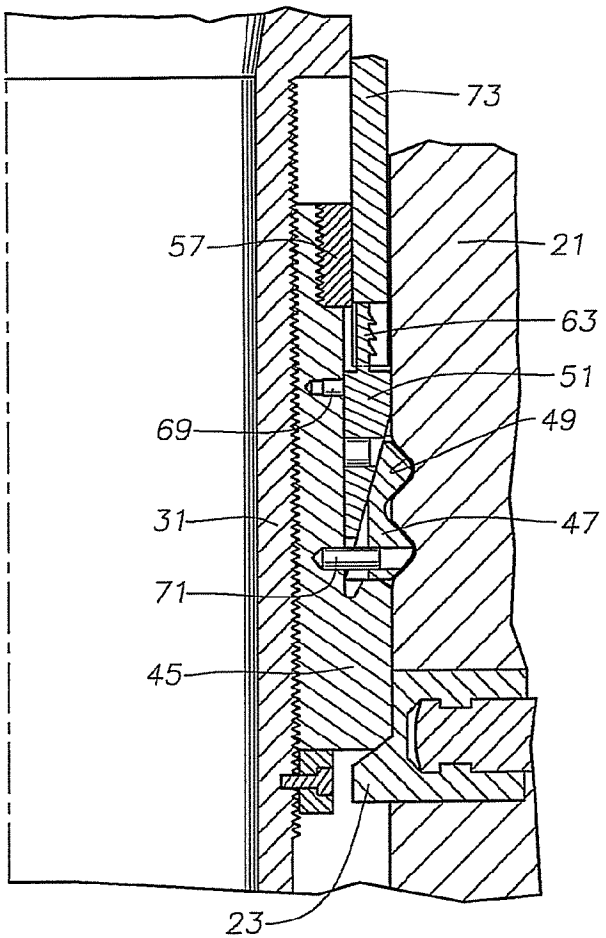
FIG. 5 is a sectional view of the casing hanger assembly similar to FIG. 4, but showing a lock ring stroked out into engagement with the surface wellhead to prevent upward movement of the casing hanger.

As mentioned, after rotating torque sleeve 73, running tool 33 will stroke torque sleeve 73 downward to push energizing ring 51 from the upper position of FIG. 3 to the lower position of FIG. 5. This movement is handled hydraulically without either vertical or rotational movement of running string 34 (FIG. 1). A hydraulic fluid passage 107 is connected to a hydraulic fluid pressure supply line (not shown) and extends downward through hub 87. Passage 107 leads through inner support body 85 to a chamber 109. Chamber 109 is defined on its lower end by a piston member 111 formed on the inner diameter of torque sleeve 73. The upper end of chamber 109 is defined by end cap 79. Piston member 111 will initially be in an upper position within chamber 109 and moves downward to the lower position shown when hydraulic fluid pressure is delivered to passage 107.

In operation, referring to FIG. 1, when the operator wishes to tie back and tension casing 29, he will make-up the string of casing 29 and attach casing hanger 31. The operator connects running tool 33 to casing hanger 31 by rotating running tool 33 relative to casing hanger 31 to engage threads 37 (FIG. 2). Outer body 45 will be in the upper position shown in FIG. 3 with its upper end in abutment with casing hanger shoulder 39. The operator secures running string 34 to the upper end of running tool 33 and lowers the assembly as illustrated in FIG. 1 until the tieback member on the lower end of casing 29 contacts subsea casing hanger 13. The operator rotates the entire assembly by rotating running string 34 to cause casing 29 to rotate to male up the tieback with subsea casing hanger 13.

After casing 29 (FIG. 1) has been tied back, the operator pulls a desired tension on casing 29 by pulling upward on running string 34 (FIG. 1), as shown in FIG. 3. Retractable load shoulders 23 would likely still be retracted at this point. After the tension has been applied, the operator extends load shoulders 23 to the extended position of FIG. 4. Stop ring 43 will be spaced below load shoulders 23. The operator then rotates torque sleeve 73, which in turn causes energizing ring 51, split ring 47 and outer body 45 to rotate in unison. The operator causes the rotation by supplying power to motor 103 (FIG. 7), which rotates drive gear 95. Drive gear 95 rotates driven gear 93, which causes inner support body 85 to rotate. Torque sleeve 73 rotates with inner support body 85 and causes rotation of outer body 45 through the engagement with lugs 63 (FIG. 6) of energizing ring 51 (FIG. 4). This rotation causes threads 41 to move outer body 45 downward until it is in contact with load shoulders 23 as shown in FIG. 4.

After rotating casing hanger outer body 45 into engagement with load shoulders 23, the operator strokes energizing ring 51 downward to push split ring 47 into profile 49, as shown in FIG. 5. The operator handles this movement by supplying hydraulic pressure to passage 107, which acts on piston 111 to drive it downward.

The operator then disengages running tool 33 from casing hanger 31 and retrieves it. To disengage, hub 87 is rotated relative to casing hanger 31 to unscrew threads 105. This can be done without retracting torque sleeve 73 because hub 87 is rotatable relative to torque sleeve 73. The operator then runs and sets seal assembly 61 (FIG. 2). The operator repeats the process for other casing strings and tubing.

The invention claimed is:

1. A casing hanger assembly for hanging a string of casing on the interior of a housing that includes an internal grooved profile and an internal load shoulder, comprising:

a tubular casing hanger comprising an upper end comprising internal threads for releasably coupling the casing hanger to a running tool and a lower end adapted to be coupled to an upper end of the string of casing;

a tubular outer body movably coupled to an external surface of the tubular casing hanger comprising a tapered external surface at a lower end for engaging the internal load shoulder of the housing;

a split ring movably coupled to an external surface of the tubular outer body comprising a tapered internal diameter and an external grooved profile adapted to mate with the internal grooved profile of the housing; and an energizing ring releasably coupled to an external surface of the tubular outer body comprising a tapered outside diameter at a lower end for engaging the tapered internal diameter of the split ring and one or more lugs at an upper end for releasably engaging the running tool.

2. The casing hanger assembly of claim 1, further comprising:

a stop ring releasably coupled to an external surface of the tubular casing hanger for limiting displacement of the tubular outer body relative to the tubular casing hanger.

3. The casing hanger assembly of claim 1, further comprising:

one or more torque keys coupled to an external surface of the tubular outer body and movably coupled to an internal surface of the energizing ring for transmitting torque from the tubular outer body to the energizing ring.

4. The casing hanger assembly of claim 3, further comprising:

a retainer ring coupled to an external surface of the tubular casing hanger for retaining the torque keys to the tubular outer body.

5. The casing hanger assembly of claim 1, wherein the energizing ring comprising a plurality of circumferentially spaced apart lugs at an upper end for transmitting torque from the running tool to the energizing ring.

6. The casing hanger assembly of claim 1, wherein the lugs at the upper end of the energizing ring comprise internal threads.

7. The casing hanger assembly of claim 1, further comprising:

one or more shear pins coupled to an external surface of the tubular casing hanger for releasably holding the energizing ring in an upper position relative to the tubular casing hanger.

8. The casing hanger assembly of claim 1, further comprising:

a spacer ring movably coupled to an external surface of the tubular casing hanger comprising a lower end coupled to the lugs of the upper end of the energizing ring; and a tubular seal assembly comprising a lower end coupled to an upper end of the spacer ring and an upper end adapted to be releasably coupled to the running tool.

9. The casing hanger assembly of claim 1, further comprising:

one or more pins coupled to an external surface of the tubular casing hanger and movably coupled to the split ring for preventing rotation of the split ring relative to the tubular casing hanger.

* * * * *